US009441485B2

(12) United States Patent
Krobath et al.

(10) Patent No.: US 9,441,485 B2
(45) Date of Patent: Sep. 13, 2016

(54) ROTARY PISTON ENGINE INCLUDING A PISTON ASSEMBLY, VEHICLE INCLUDING THE ROTARY PISTON ENGINE AND A MANUFACTURING METHOD FOR THE PISTON ASSEMBLY

(71) Applicant: AVL List GmbH, Graz (AT)

(72) Inventors: Andreas Krobath, Graz (AT); Michael Steinbauer, Graz (AT)

(73) Assignee: AVL List GmbH, Graz (AT)

( * ) Notice: Subject to any disclaimer, the term of this patent is extended or adjusted under 35 U.S.C. 154(b) by 152 days.

(21) Appl. No.: 14/148,485

(22) Filed: Jan. 6, 2014

(65) Prior Publication Data

US 2014/0186204 A1 Jul. 3, 2014

Related U.S. Application Data

(63) Continuation of application No. PCT/EP2012/002863, filed on Jul. 6, 2012.

(51) Int. Cl.
*F02B 53/00* (2006.01)
*F01C 21/02* (2006.01)
(Continued)

(52) U.S. Cl.
CPC ..... *F01C 21/02* (2013.01); *F01C 1/22* (2013.01); *F01C 21/008* (2013.01); *F01C 21/08* (2013.01); *F04C 29/0078* (2013.01)

(58) Field of Classification Search
CPC ..... F01C 21/02; F01C 21/008; F01C 21/08; F01C 1/22; F16C 41/001
USPC ..... 384/91, 93, 96, 267, 282, 585, 903
See application file for complete search history.

(56) References Cited

U.S. PATENT DOCUMENTS 3,827,835 A * 8/1974 Higuchi ..... F01C 1/22 418/113
3,941,525 A 3/1976 Wilmers et al.
(Continued)

FOREIGN PATENT DOCUMENTS

DE 22 58 712 A1 6/1973
DE 40 05 023 A1 3/1991
(Continued)

OTHER PUBLICATIONS

International Search Report in International Application No. PCT/EP2012/002863 dated Jul. 26, 2013.
(Continued)

*Primary Examiner* — Nicholas J Weiss
*Assistant Examiner* — Jason T Newton
(74) *Attorney, Agent, or Firm* — Knobbe, Martens, Olson & Bear, LLP

(57) ABSTRACT

A piston assembly is disclosed. In one aspect, the piston assembly includes a rotary piston, wherein the rotary piston comprises a first axis of rotation, a central bore having bore axis and at least two curved first constraint surfaces, and wherein the bore axis substantially corresponds to the first axis of rotation. The piston assembly also includes a substantially hollow-cylindrical bearing ring configured to be at least partially inserted in the central bore. The piston assembly further includes at least one fuse body configured to connect the rotary piston and the bearing ring, and to transmit, at least temporarily, a force in the two opposite axial directions relating to the first axis of rotation between the rotary piston and bearing ring.

13 Claims, 12 Drawing Sheets

(51) Int. Cl.

| | |
|---|---|
| ***F01C 1/22*** | (2006.01) |
| ***F01C 21/00*** | (2006.01) |
| ***F01C 21/08*** | (2006.01) |
| *F04C 29/00* | (2006.01) |

(56) References Cited

U.S. PATENT DOCUMENTS

| | | | | |
|---|---|---|---|---|
| 4,345,885 | A * | 8/1982 | Turner | F01C 21/04 418/90 |
| 4,940,400 | A | 7/1990 | Speiser et al. | |
| 5,011,385 | A | 4/1991 | Eiermann | |
| 5,203,307 | A * | 4/1993 | Burtis | F01C 19/04 123/205 |
| 2014/0069273 | A1 * | 3/2014 | Biddulph | F01C 1/22 92/177 |

FOREIGN PATENT DOCUMENTS

| | | | |
|---|---|---|---|
| FR | 2 234 461 | A1 | 1/1975 |
| JP | S48-063305 | | 9/1973 |
| JP | S64-063602 | | 3/1989 |
| JP | H01-305103 | | 12/1989 |
| JP | 2009-517583 | A | 4/2009 |
| WO | WO 2007/062116 | A1 | 5/2007 |
| WO | WO 2010/093352 | A1 | 8/2010 |

OTHER PUBLICATIONS

Japanese Office Action, dated Jun. 6, 2016, received in corresponding Japanese Patent Application No. 2014-517525.

* cited by examiner

ROTARY PISTON ENGINE INCLUDING A PISTON ASSEMBLY, VEHICLE INCLUDING THE ROTARY PISTON ENGINE AND A MANUFACTURING METHOD FOR THE PISTON ASSEMBLY

CROSS-REFERENCE TO RELATED APPLICATIONS

This application is a continuation application, and claims the benefit under 35 U.S.C. §§120 and 365 of PCT Application No. PCT/EP2012/002863, filed on Jul. 6, 2012, which is hereby incorporated by reference. PCT/EP2012/002863 also claimed priority from Austrian Patent Application No. A 992/2011 filed on Jul. 7, 2011, which is hereby incorporated by reference.

BACKGROUND

1. Field

The described technology generally relates to a rotary piston engine including a piston assembly, a vehicle including a rotary-piston engine and a manufacturing method for the piston assembly.

2. Description of the Related Technology

Generally, in the rotary piston engines, the rotary pistons are mounted with a roller bearing or with a plain bearing on an eccentric shaft. The rotary piston is guided between adjacent side panels or housing from the rotary piston engine. The following are to be understood as both a bearing ring, the outer bearing ring of the rolling bearing and the bearing sleeve of a plain bearing. Some types of rotary engines have an unsatisfactory lifetime.

SUMMARY

One inventive aspect is a rotary piston engine which is particularly suitable for use in electric vehicles with a range-extender with generator.

Another aspect is a rotary piston engine which can be used in rotary engines independently from a range extender or independently of vehicles application.

Another aspect is an improved rotary piston engine, which is particularly characterized by a prolonged lifetime.

Another aspect is a rotary piston engine which includes a piston assembly, wherein the piston assembly is mounted in particular to an eccentric shaft of the rotary piston engine. The piston assembly includes a rotary piston. The rotary piston is rotated in the rotary piston engine about its axis of rotation, in the following the so called first axis of rotation. The rotary piston comprises a central bore with an associated bore axis and with at least two first curved particular constraint surface. The bore axis substantially coincides with the first axis of rotation. The piston assembly further comprises a substantially hollow-cylindrical bearing ring. The bearing ring is provided to be at least partly inserted into the central bore. Furthermore, the piston assembly includes at least one fuse body wherein the fuse body is provided to connect the rotary piston and the bearing ring positively connected. In particular the fuse body is provided, to transmit a force of the bearing ring on the rotary piston along the first axis of rotation or in the axial direction of, at least at times, or in the opposite direction.

Another aspect is a rotary piston engine which counteracts an especially undesirable displacement of the bearing ring relative to the rotary piston along the first axis of rotation or in the axial direction, in particular relating to the first axis of rotation. The fuse body positively connects the rotary piston with the bearing ring, an undesirable relative displacement of the bearing ring and rotary piston is counteracted. Thus, an increased wear of the bearing ring, rotary piston, housing or adjacent side plate is encountered and solves the problem. Further, rolling elements or the bush or the eccentric shaft stay essentially unaffected.

Another aspect is a rotary engine, in which a substantially triangular shaped piston rotates on an eccentric shaft arranged in a housing of the engine.

At least one of the above described rotary engines is applicable to a rotary piston engine with a rotary piston with two, four or more corners. Furthermore, the invention can generally be used in rotary engines with two, three or more adjacent pistons.

Another aspect is a rotary piston engine which comprises an internal combustion engine with a rotary piston, wherein the rotary piston being rotated during operation around its axis of rotation, and in particular the axis of rotation during operation follows a closed trajectory and in particular a circular path.

Another aspect is a rotary piston which comprises a body which rotates during the operation of a rotary piston engine about its axis of rotation within the housing of the rotary piston engine and in particular causes a torque on the eccentric shaft of the rotary piston engine. In particular, for interaction with the eccentric shaft and for supporting on the eccentric shaft the rotary piston comprises a central bore with a bore axis. Customarily, the rotary piston comprises three curved first constraint surfaces, wherein the present invention is not confined to substantially triangular shaped rotary pistons. Together with the housing of the rotary piston engine the constraint surfaces form the first combustion chamber. The first constraint surfaces are during the operation of the rotary piston engine temporarily applied with a gas pressure of a combustion process. The axis of the bore of the rotary piston substantially corresponds to its axis of rotation or the first axis of rotation.

The bearing ring can be a body which is insertable into the central bore of the rotary piston. During the operation of the rotary piston engine the bearing ring is at least partly completely covered by the central bore of the rotary piston. The bearing ring is as an outer bearing ring of a roller bearing or a bearing sleeve of a plain bearing designed. The bearing ring serves for the mounting of the rotary piston on the eccentric shaft of the rotary piston engine. In particular, the bearing ring serves as a running surface for rolling elements between the rotary piston and eccentric shaft. The bearing ring serves as a running surface for a region of the eccentric shaft, as far as the rotary piston is slidingly supported on the eccentric shaft. A substantially hollow-cylindrical bearing ring is shorter or narrower or lower than the depth or length of the central bore and the thickness of the first rotary piston along its axis of rotation, in particular if the central bore is also provided with an internal toothing.

A fuse body can be a body which particular positively connects the rotary piston to the bearing ring. The fuse body acts by positive connection against undesired displacement of the bearing ring within the central bore in the axial direction, in particular with respect to the first axis of rotation and in the direction of the first rotation axis and the bore axis. At least one fuse body in particular serves at least temporarily, to transmit a force between rotary piston and bearing ring along the first axis of rotation. If the bearing ring during operation of the rotary piston engine in the central bore in particular by reaction forces from the supporting of the rotary piston is pushed to a displacement, the fuse body exerts an opposing force, by means of which the bearing ring is held in place.

For illustration of the particular embodiments the terms "surface of the bore" and "outer surface of the bearing ring" are established. The surface of the bore limits the central bore of the rotary piston, in particular in radial direction. Furthermore the bearing ring comprises the so-called outer surface of the bearing ring which faces the surface of the bore. The outer surface of the bearing ring is arranged adjacent to the surface of the bore where the bearing ring is received in the central bore.

According to one embodiment, the first outer surface of the bearing ring and/or the surface of the bore comprise an insertion aid, which is designed especially as angular face, for example, as a chamfer. The insertion aid acts, in particular to facilitate the placing of the bearing ring in the central bore. It comprises the substantially hollow-cylindrical bearing ring and/or the surface of the bore at both ends one chamfer each. Therefore the effort is reduced, to orientate the bearing ring before inserting it into the central bore.

According to another embodiment, at least one fuse body is charged by a force which acts along a radius of central bore. Hereinafter this is referred to as "radial force" or "radial load". The radial force is used to move or force at least one fuse body to its predetermined position during the intended operation of the rotary piston assembly. An inserted fuse body is supported by the radial force in its predetermined position. The radial force is exerted by a spring means to one fuse body, wherein the spring means is formed in particular as elastomer element, spiral spring, cup spring, leaf spring or a compressed fluid volume. A fuse body is charged by a radial force, which is effected by means of a mechanical oil pressure to a boundary surface of the fuse body. Several or all of the existing fuse bodies are each acted upon by a radial force.

According to one embodiment, the surface of the bore comprises at least a first recess or recess of the surface of the bore. The first recess extends from the surface of the bore into the material of the rotary piston. A first recess serves at least for partial accommodation of at least one fuse body. The surface of the bore comprises two, three, four or more first recesses. The outer surface of the bearing ring comprises at least one second recess or recess of the bearing ring, which serves in particular for at least partially receiving at least one fuse body. The fuse body is received for operation of the piston assembly, both the first recess and the second recess, in particular positively connected. It is enabled by the fuse body in particular by means of a positive connection to transmit a force between the rotary piston and bearing ring. The surface of the bore comprises at a plurality of different positions each a first recess and a second recess, in particular arranged opposite to each other and to house one fuse body each, in particular positively connected. A force which comprises to be transmitted between the bearing ring and the rotary piston can be divided on to several fuse bodies. The fuse body is essentially dowel type, cylindrical, prismatic or wedge shaped with a longitudinal axis and along a radius of disposed central bore, the first recess receiving the fuse body is particularly formed as a blind hole in the rotary piston. The second recess is formed in the bearing ring as a through bore or, as a blind hole. The fuse body received by the recesses in particular positively connected acts against undesired displacement of the bearing ring within the central bore along the first axis of rotation.

Another embodiment allows to plunge the fuse body against the radial force in the first or second recesses substantially completely, before the bearing ring is inserted into the central bore. The radial force causes when the bearing ring comprises been placed in its predetermined position, that the fuse body at least partially enters an opposing first or second recess. Thus, the bearing ring is secured in its particular position in the axial direction.

According to another embodiment, the surface of the bore comprises an annular first recess around the central bore which is in particular formed as a circumferential groove comprising in particular a rectangular, U-shaped or V-shaped cross-section and/or is in particular formed in the material of the rotary piston. A plane of symmetry of the circumferential groove is oriented perpendicular to the first axis of rotation. The outer surface of the bearing ring comprises a second annular recess around the central bore, which is in particular formed as a circumferential groove comprising in particular a rectangular, U-shaped or V-shaped cross-section and/or is in particular formed in the material of the bearing ring. A plane of symmetry of the circumferential groove is oriented perpendicular to the first axis of rotation. The at least one fuse body is particularly in the operating state of the piston assembly fitted in both the first recess and the second recess and is in particular positively connected. A plurality of fuse bodies is in particular positively connected both the first recess and the second recess. The at least one fuse body comprises a polygonal cross-section which is matched to the cross sections of the first and second recesses. The fuse body contacts each the first recess and a second recess extensive. The fuse body positively connects the rotary piston to the bearing ring in particular for transmission of a force between rotary piston and bearing ring. The fuse body acts against an undesired displacement of the bearing ring within the central bore along the first axis of rotation.

According to another embodiment, the fuse body is designed as a connecting ring. The inner diameter of the connecting ring can be smaller than the outer diameter of the bearing ring. The connecting ring is interrupted by a third recess and is in the following called as "ring section". Thus the fuse body which is formed as an ring section extends only along a part of the surface of the bore, along an annular loop of the first or second recess between about 10 degrees and about 350 degrees of its full range, between about 190 degrees and about 340 degrees, between about 200 degrees and about 330 degrees, between about 200 degrees and about 330 degrees, between about 210 degrees and about 320 degrees, between about 220 degrees and about 310 degrees, between about 230 degrees and about 300 degrees, between about 240 degrees and about 290 degrees, or between about 250 degrees and about 280 degrees.

According to another embodiment, the substantially annular fuse body is transformable in an elastically deformed state, especially with modified inner diameter. The fuse body can be made of an elastic material, a steel material, or a spring steel. In an elastically deformed state, the fuse body's inner diameter is greater than the outer diameter of the bearing ring. In this state, the fuse body can be inserted in the second recess. In another elastically deformed state, the outer diameter of the fuse body is not bigger than the outer diameter of the bearing ring, or no bigger than the diameter of the central bore. In this state the bearing ring with the fuse body inserted can be inserted into the central bore. Further, it causes an elastic restoring force after the bearing ring is placed in its predetermined position, that the fuse body with its relaxed state at least partly entering the first recess. Thus, the bearing ring is secured in its position.

Another embodiment is for facilitated insertion of the bearing ring in the central bore combinable with the first design (insertion aid).

In another embodiment, the surface of the bore comprises an annular first recess around the central bore which is formed as a circumferential groove comprising a rectangular, U-shaped or V-shaped cross-section and/or in particular is formed in the material of the rotary piston. A plane of symmetry of the circumferential groove is oriented perpendicular to the first axis of rotation. The outer surface of the bearing ring comprises a second annular recess around the central bore, which is in particular formed as a circumferential groove comprising in particular a rectangular, U-shaped or V-shaped cross-section and/or in particular is formed in the material of the bearing ring. A plane of symmetry of the circumferential groove is oriented perpendicular to the first axis of rotation. The at least one fuse body is received in both the first recess and the second recess, particularly in the operating state of the piston assembly, or it is positively connected. A plurality of fuse bodies are received in both the first recess and the second recess they are positively connected.

In one embodiment, at least one fuse body is characterized by an elongated geometry with an envelope or Lateral surface and a base surface. The at least one fuse body extends from the base surface along a main extension direction, which substantially follows the first recess or the second recess around the first rotation axis. The individual cross-sections of the fuse bodies along the main extension direction are smaller than those of each cross-section of first recess and second recess. The envelope surface comprises along the main extension direction several contact areas, which are adapted each to carry a force component normal to the first and second recesses. The fuse body is used in particular by means of the contact areas, to transmit normal force components to the recesses. The fuse body is such that it completely compressible in a first and/or second recess. In one embodiment, in preparation for the insertion of the bearing ring in the central bore, the fuse body mostly, entirely be inserted in the first or the second recess, and is transferred into an elastically deformed state. After insertion of the bearing ring in the central bore, and in particular by the alignment of the first and second recesses with respect to each other, the fuse body relaxed partially, completely, by entering partially into the receiving it first or second recess opposite recess. The fuse body even after entry into the opposite recess stays elastically deformed, especially for improved transmission of a force between the bearing ring and the rotary piston. When partly entering into opposite lying recesses, contact areas can also contact opposite lying recesses, in particular to transmit normal force components on the recesses. The elastically deformed fuse body counteracts the undesired relative displacement of the bearing ring and the rotary piston, in particular also in the circumferential direction with respect to the first axis of rotation.

For the manufacturing of a fuse body an elongated raw material is used with a main extension direction, a wire or band which is cold formed to a fuse body in particular with solidification, extruded. In this case, the elongate raw material is repeatedly displaced in planes transverse to the main direction of extension, wherein in particular the starting material solidifies. Examples of regular geometries are, a cylindrical spiral, a maeander shape with an essentially unchanging period. The displacement of the raw material is wavelike between two mutually perpendicular planes.

At least two of the embodiments can be combined with each other for facilitated insertion of the bearing ring into the central bore.

According to another embodiment, the first bore comprises an annular recess around the central bore, which is in particular formed as a circumferential groove having in particular a rectangular, U-shaped or V-shaped cross-section and/or in particular is formed in the material of the rotary piston. A plane of symmetry of the circumferential groove is oriented perpendicular to the first axis of rotation. The outer surface of the bearing ring comprises a second annular recess around the central bore, which is in particular formed as a circumferential groove having in particular a rectangular, U-shaped or V-shaped cross-section and/or is in particular formed in the material of the bearing ring. A plane of symmetry of the circumferential groove is oriented perpendicular to the first axis of rotation. The at least one fuse body is accommodated particularly in the operating state of the piston assembly in both, the first recess and the second recess, in particular positively connected. A plurality fuse bodies are accommodated from both the first recess and the second recess, in particular positively connected.

The at least one fuse body can be characterized by a substantially rectangular cross-section. The fuse body comprises with respect to the first axis of rotation one inner and one outer circumferential surface of the fuse body and two end faces. The end faces are each arranged substantially perpendicular to the circumferential surface of the fuse body and substantially perpendicular to the first axis of rotation. The circumferential surface of the fuse body and the end faces of fuse body are particularly intended to transfer normal force components on a first recess and a second recess.

According to another embodiment, the fuse body is designed as a connecting ring. The inner diameter of the connecting ring is smaller than the outer diameter of the bearing ring. The connecting ring is interrupted by a third recess and subsequently called ring section. Thus the fuse body, which is formed as a ring section, extends only along a part of the surface of the bore, along an annular recess between about 10 degrees and about 350 degrees of its scope, between about 190 degrees and about 340 degrees, between about 200 degrees and about 330 degrees, between about 200 degrees and about 330 degrees, between about 210 degrees and about 320 degrees, between about 220 degrees and about 310 degrees, between about 230 degrees and about 300 degrees, between about 240 degrees and about 290 degrees, or between about 250 degrees and about 280 degrees.

According to another embodiment, the fuse body is transformable in an elastically deformed state, especially with modified inner diameter. The elastically deformable fuse body is designed as a ring section. The surface area of the cross-section of the fuse body is smaller than the cross-section of the first or second recesses accommodating the fuse body. The fuse body comprises an elastic material, can be made of a steel material or a spring steel. In a first elastically deformed state the inner diameter of the fuse body is bigger than the outer diameter of the bearing ring. In this state, the fuse body can be inserted in the second recess. In a second elastically deformed state, the outer diameter of the fuse body is smaller than the outer diameter of the bearing ring. In this state the bearing ring with inserted fuse body can be inserted into the central bore. Further, it can cause an elastic restoring force the fuse body with its relaxed state to enter at least partly the first recess after the bearing ring is placed in its predetermined position. Thus the bearing ring is secured in its axial position.

According to another embodiment, at least one of the end faces comprises a wave form shape. Along the so-called wave formed end face there are wave formed protrusions of the end face. The protrusions of the end face serve in particular to contact a first and/or second recess, and in particular to transfer a component of a normal force on a first and/or second recess. Both end faces are formed with wave formed protrusions of the end face. The effort for manufacturing the fuse body is reduced with respect to the protrusions of the end face, because the fuse body needs to be machined only in the area of the protrusion of the end face with low dimensional tolerance. Further, the protrusion of the end face can allow that a lubricant between the bearing ring and the rotary piston can be replaced. If in a position of the fuse body a protrusion of the end face of the first end face no protrusion of the end face of the opposite end face is facing, the fuse body can be elastically deformed by inserting it into a first or second recess. Elastic restoring forces cause an improved contact between the fuse body and a first recess and/or a second recess. The elastically deformed fuse body counteracts an undesired relative movement of the bearing ring and the rotary piston, in particular also in the circumferential direction with respect to the first axis of rotation.

For the manufacturing of a fuse body of this embodiment an elongated raw material with a main extension direction is a wire or band which is particularly cold-formed with solidification to a fuse body, by forced flowing.

According to another embodiment, at least one of the fuse body circumferential surfaces or one of the end faces of the fuse body comprises at least one end face projection. Only the at least one end face projection of the end face is intended to contact a first and/or second recess, especially for transmitting a component of a normal force. Both end faces comprise end faces projections. The effort for manufacturing a fuse body with a protrusion of the end face is reduced because the end face projections are limited deformable by inserting the fuse body in the first or second recesses. Further, it is allowable by the end face projections that a lubricant between the bearing ring and the rotary piston can be replaced. For the manufacturing of a fuse body according to one embodiment, an elongated raw material with a main direction of extension is used, in particular a wire or band, the raw material for the fuse body is particularly cold formed with solidification, extruded.

Another embodiment is the design of the fuse body as a ring section, as an elastically deformable fuse body and protrusion of the end face are combinable. Manufacturing costs of the fuse body are reduced by only a few areas of the fuse body must be manufactured with low tolerance measure. The effort for manufacturing the piston assembly is reduced by a resilient fuse body, because the fuse body can be sunk in one of the recesses prior to insertion of the bearing ring into the central bore.

According to another embodiment, the design of the fuse body as a ring section, as an elastically deformable fuse body with end face projections are combined. A circumferential surface of the fuse body comprises at least one projection, the outer circumferential surface with respect to the first axis of rotation. Manufacturing costs for the fuse body are reduced by only a few areas of the fuse body have to be produced with low size tolerance. Further with resilient design of the fuse body the effort to manufacture the piston assembly is reduced, by sunk the fuse body in one of the recesses prior the bearing ring is inserted into the central bore.

According to another embodiment, the fuse body comprises a predetermined cross-section. The shape of the fuse body with a predetermined cross-section serves particularly to transmit a component of the normal force to a first recess and/or a second recess. To such cross-sections are particularly suitable which allow linear- or surface-, but especially contacts which are suitable for transmission of a force, between a fuse body on the one hand and on the other hand a first recess and/or second recess. Thus, the cross-section comprises more particularly more than one corners or vertices, which are provided for contacting a first recess and/or a second recess. The cross-section is triangular, with four corners, polygonal, rectangular, square, circular, X-shaped or U-shaped. The cross section is circular, elliptical or oval. The fuse body is twisted so that the same corner or vertex is applied at various recesses in particular to transmit forces.

According to another embodiment, the fuse body comprises at least one metallic material. With this metallic design the fuse body endures higher surface pressure or loads, such as many plastics. This fuse body can be manufactured with high dimensional tolerance. A metal material is selected from a group including iron, aluminum, copper, zinc (and others) and also alloys containing these metals. The metallic material prior to the manufacture of fuse body comprises a elongate shape, a wire or band shape. The fuse body can be manufactured by a forming process, a pressure forming process, by extrusion, by cold forging. The fuse body can be formed of a wire-like or band-like raw material According to another embodiment, the fuse body is manufactured by a forging process, with a method shaped by pressure. In particular, the material is solidificated during the forming. The fuse body which is produced by a forging process comprises a low degree of tolerance. The metallic material of the fuse body comprises prior to the manufacturing an elongate shape, formed as a wire or band. The fuse body is manufactured by an extrusion process, by cold extrusion process, especially for improved dimensional stability and especially higher solidification of the material. The metallic material prior to the manufacture of fuse body comprises an elongated shape, a wire or band.

A rotary piston engine can comprise a rotary piston assembly. The rotary piston engine is particularly designed as a rotary piston engine (Kreiskolbenmaschine). The rotary piston is mounted on an eccentric shaft of the rotary piston engine, in particular by means of a rolling bearing or sliding bearing. The bearing ring of the piston assembly of the present invention is constructed as outer bearing ring of the bearing or bushing of the sliding bearing. The outer bearing ring or the bearing bush are arranged in the central bore of the rotary piston. In particular, for reduced wear of the rotary piston engine, the bearing ring is arranged along the first axis of rotation of the rotary piston, in particular axially substantially immobile by means of the at least one in fuse body. The proposed positively connected connection of bearing ring and rotary piston effects, a space-saving and reliable axial location. The lifetime of the bearings is improved by the in particular axial fixation of the bearing ring in the central bore. The rotary piston engine with a piston assembly according to the invention is designed to drive a generator for electric energy supply, is provided in particular in a vehicle. These inventive rotary piston engine is operated with less vibration than a reciprocating internal combustion engines. Also the start of a rotary piston engine with rotary piston by a passenger of the vehicle is less noticeable than the start of a reciprocating internal combustion engine. The rotary piston engine provides a temporary mechanical output of at least about 1 KW, about 2 KW, about 5 KW, about 10 KW, about 20 KW, about 50 KW, about 100 KW, about 200 KW or more. The combustion engine comprises a plurality of piston assemblies which in particular are supported on the same eccentric shaft. The rotary piston engine can be operated at an ambient temperature between about −40 degrees centigrade to about 100 degrees centigrade.

A vehicle can comprise a rotary piston engine according to the invention with at least one piston assembly. As part of a so-called "range extender" supplies these rotary piston engine at least temporarily, a generator with energy for converting mechanical energy into electrical energy. The electric power is in particular rectified and is supplied to energy storage device or an electrochemical secondary battery or the vehicle and/or an electric motor of the vehicle. The electric motor is provided to drive at least one wheel of the vehicle. The rotary piston engine is started, when the electrochemical energy stored in the energy storage device to reach the destination of the vehicle is insufficient. The rotary piston engine is started, if the secondary battery removable electric power falls below the demand of the electric motor.

Another embodiment is a method of manufacturing of a piston assembly including providing a circular piston with a central bore, a substantially hollow cylindrical bearing ring and at least one fuse body. The central bore comprises at least one first recess and the bearing ring comprises at least one second recess. These recesses are provided for receiving the at least one fuse body. The manufacturing process is characterized by two manufacturing steps, the temporal sequence of these steps by the numbering of the claim is not mandatory. Below the advantages of both temporal sequences are described.

According to another embodiment, the bearing ring is initially inserted into the central bore, especially in its predetermined position for operation. The first and second recesses are aligned. Subsequently, the at least one fuse body is positively connected inserted through the second recess until into the first recess. The bearing ring is within the central bore positively connected by means of the fuse body, and is therefore secured against any unwanted movement along the first rotation axis.

Another embodiment is initially at least a fuse body arranged in a first or second recess in the bearing ring or rotary piston, especially against a radial force of a spring means, and substantially completely inserted. Subsequently the bearing ring is inserted into the central bore. The first and second recesses are aligned to one another such, that the at least one fuse body is suppressed only partially, especially by means of the radial force in the receiving recess, which is opposite to the recess in which the fuse body is arranged. The bearing ring is secured within the central bore by a positive connection by means of the fuse body to avoid any unwanted movement along the first rotation axis.

According to another embodiment, at least one fuse body is initially inserted into a first or second recess, in particular such, that the fuse body is completely sunk in the first or second recess. The at least one fuse body is converted into an elastically deformed state. Subsequently the bearing ring is inserted into its predetermined position within the central bore. The first and second recesses are aligned. After aligning the recesses the elastically deformed fuse body takes its relaxed state in independent manner, wherein the fuse body moves only partially out of the receiving recess in the opposite lying recess. The bearing ring is secured against unwanted displacement along the first axis of rotation within the central bore by means of positive connection by the fuse body.

BRIEF DESCRIPTION OF THE DRAWINGS

FIG. 8A shows a piston assembly, wherein the bearing ring is disposed in its predetermined location within the cylinder bore. FIG. 8B shows a rotary piston assembly, according to another embodiment, in a sectional view, wherein the bearing ring has not yet reached its predetermined position within the central bore.

FIG. 9A shows in a sectional view a rotary piston with a V-shaped first recess, an outer bearing ring with a second also V-shaped recess and a fuse body according to another embodiment. FIG. 9B shows the bearing ring with a formed in second recess which is formed as a V-shaped groove.

FIG. 10A shows a sectional view of a piston assembly, according to another embodiment, with elastically deformable fuse body with protrusions of the sidewall. FIG. 10B shows a fuse body whose fuse body circumferential surface also comprises a projection.

DETAILED DESCRIPTION

Figure 1:
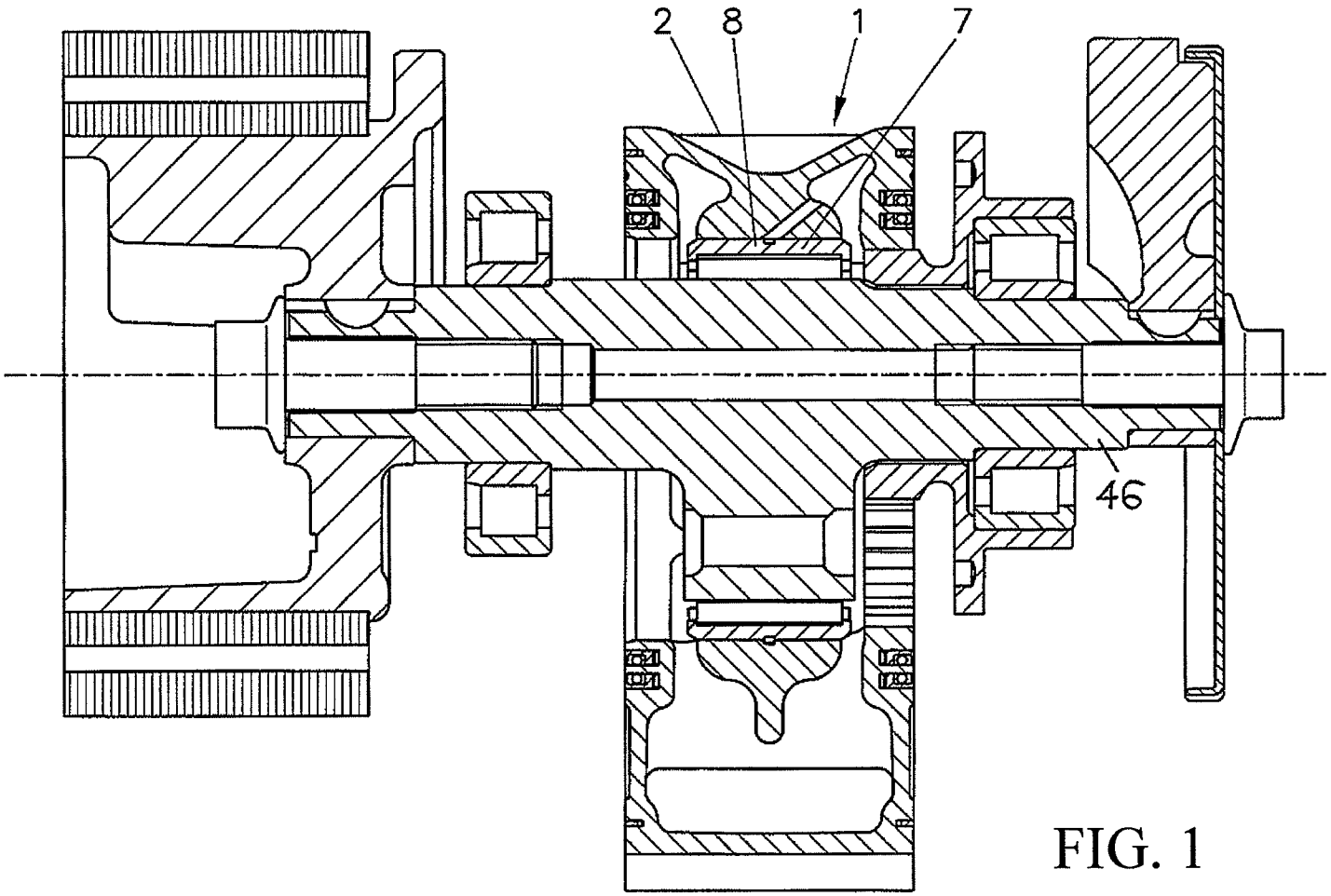
FIG. 1 shows a piston assembly in a fitted state according to one embodiment.

Embodiments will be described with reference to the accompanying drawings. FIG. 1 shows a piston assembly in a fitted state according to one embodiment. The piston assembly 1 is mounted on the eccentric shaft 46 by means of a rolling bearing. Shown in the fitted state are the outer bearing ring 7 of the rolling bearing, the rotary pistons 2 and the fuse body arranged in first and second recesses. The fuse body acts against an undesired movement of the outer bearing ring 7 within the central bore of the circular piston 2 by means of a positive connection.

Figure 2:
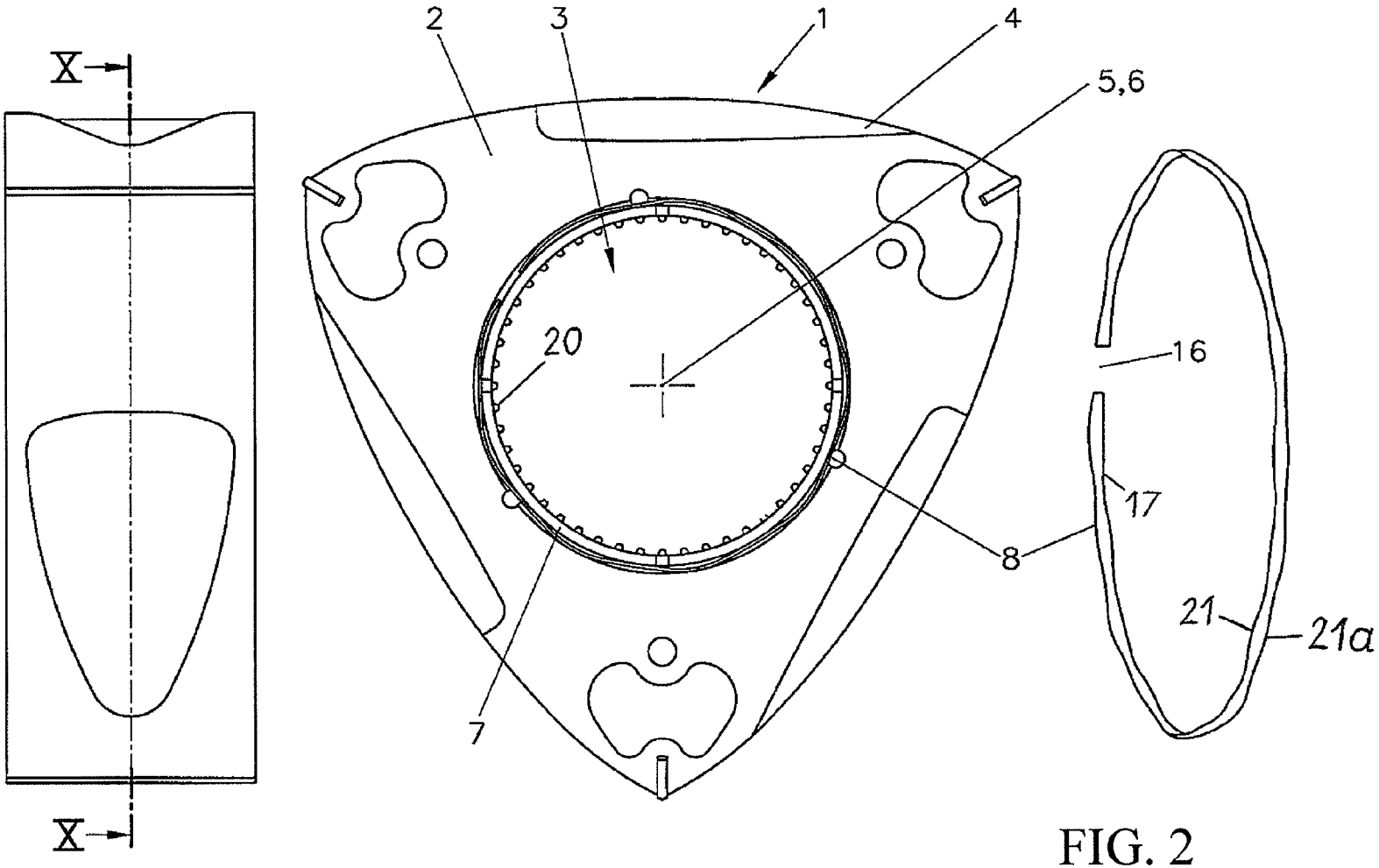
FIG. 2 shows a piston assembly and a fuse body of the wave form shaped end faces of the fuse body according to another embodiment.

FIG. 2 shows a piston assembly 1 and a fuse body 8 according to another embodiment with wave form shaped end faces 17 of the fuse body 8. The rotary piston 2 comprises a circular central bore 3, three curved first constraint surface 4, an axis of a bore 5 and a first axis of rotation axis 6. In the present case the axis of the bore 5 and the first axis of rotation 6. The rotary piston also comprises an inner toothing 20 for interaction with the eccentric shaft not shown. The outer bearing ring 7 and the fuse body 8, both shown in sectional view, are arranged in the central bore 3. The fuse body 8 is interrupted by the third recess 16 and comprises wave form shaped end faces 17. The protrusions of the end face can allow, that a lubricant between the bearing ring and the rotary piston can be replaced. The protrusion of the end face 21, 21*a* are opposite to each other. The protrusion of the end faces 21, 21*a* are provided for contacting or to positively connect with the first and second recess. The fuse body 8 is transformable in an elastically deformed state, in particular for the insertion of the bearing ring 7 in the central bore 3.

Figure 3:
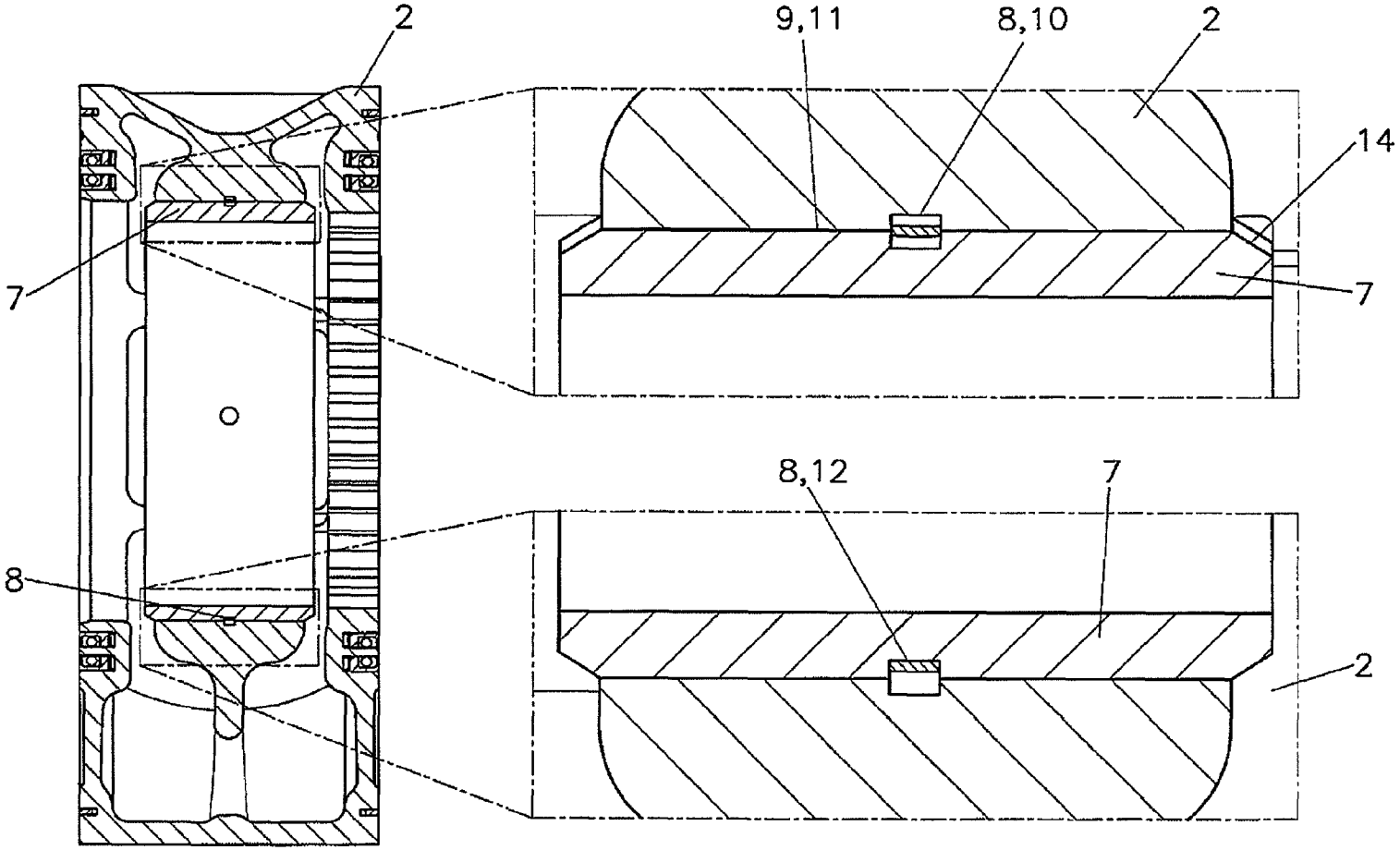
FIG. 3 shows a piston assembly in sectional view, an enlarged portion and a bearing ring with bevels as insertion aid according to another embodiment.

FIG. 3 shows an inventive piston assembly 1 according to another embodiment in sectional view and two enlarged details. In the rotary piston 2 is the outer bearing ring 7 fitted and by means of a connecting ring 8 secured against any unwanted axial displacement within the rotary piston 2. The bearing ring 7 comprises a chamfer 14 to facilitate insertion into the rotary piston 2. The surface of the bore 9 and outer surface of the bearing ring 11 coincide. It is also shown, that the connecting ring 8 is arranged in both the first recess 10 and second recess 12.

Figure 4:
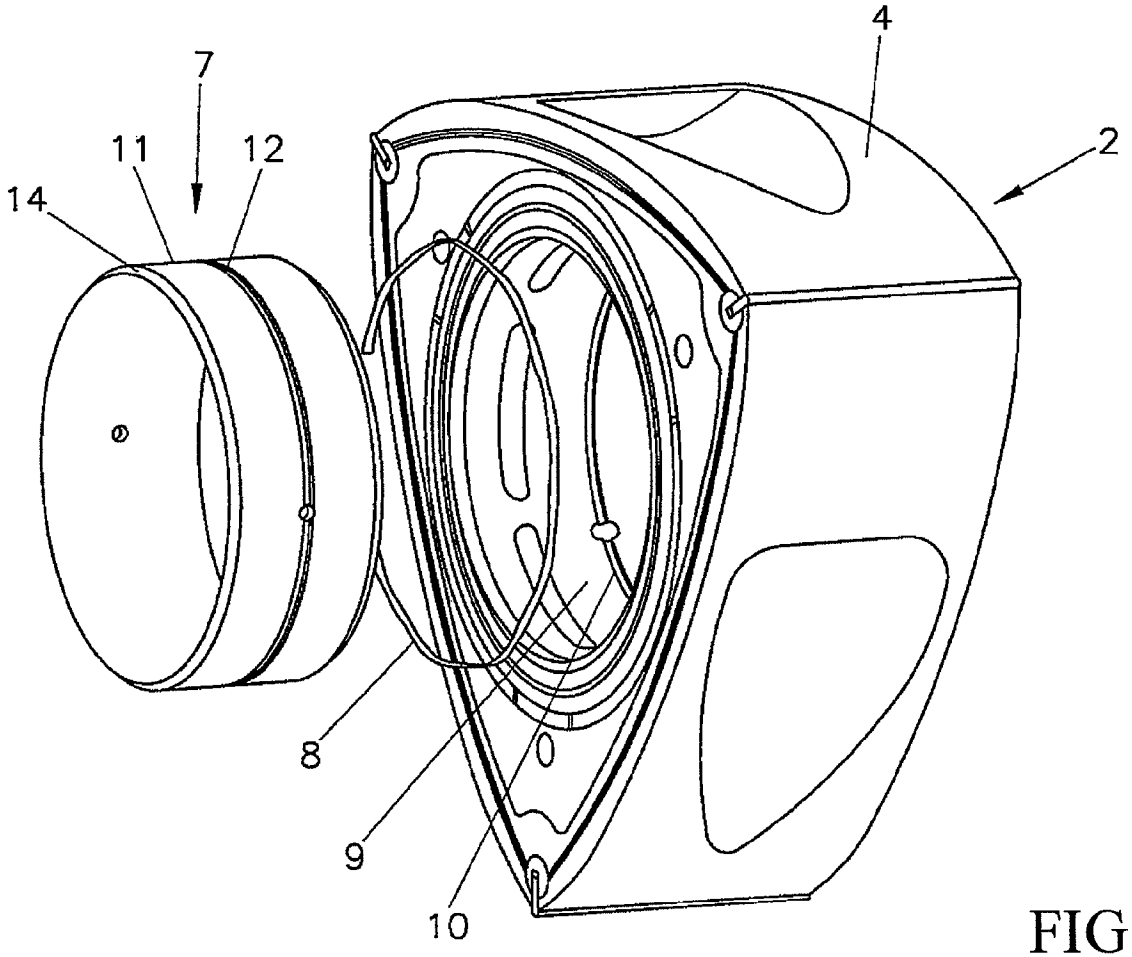
FIG. 4 shows a piston assembly of the wave form shaped end faces of the fuse body in disassembled state according to another embodiment.

FIG. 4 shows an inventive piston assembly 1 according to another embodiment with wave form shaped end faces of the fuse body 8 in disassembled state. In the surface of the bore 9 a first recess 10 is formed as a circumferential groove. In the outer bearing ring 7 or the outer surface of the bearing ring 11 a second recess 12 is formed as a circumferential groove 12. The bearing ring 7 comprises two chamfers 14.

Figure 5:
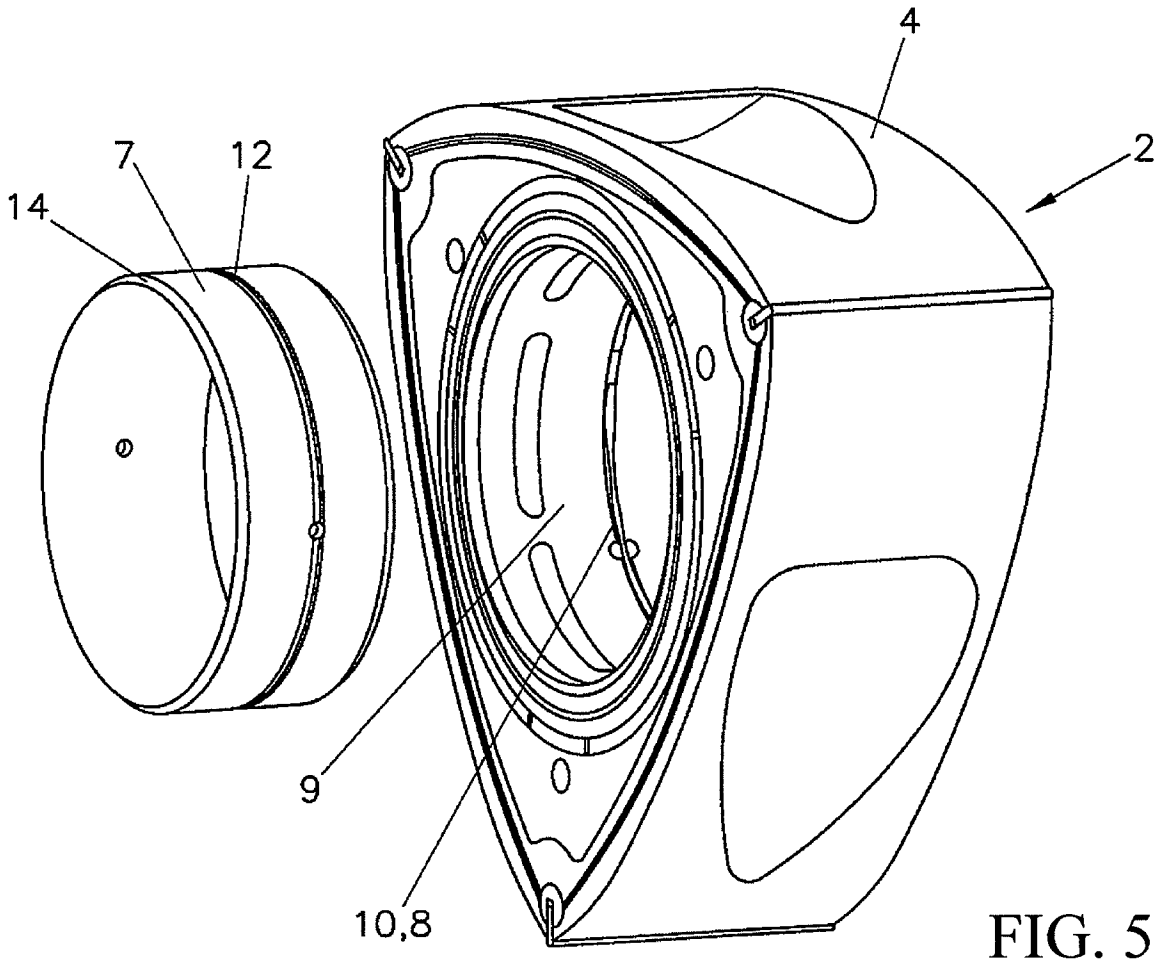
FIG. 5 shows the piston assembly of FIG. 4, wherein the fuse body is inserted into the first recess of the surface of the bore.

FIG. 5 shows the piston assembly 1 according to FIG. 4, where the fuse body 8 is inserted into the first recess 10 of the surface of the bore 9. The fuse body 8 is formed as a connecting ring, and is inserted in elastically tensioned state into the first recess 10. Now the outer bearing ring 7 can be inserted into the central bore of the circular piston 2.

Figure 6:
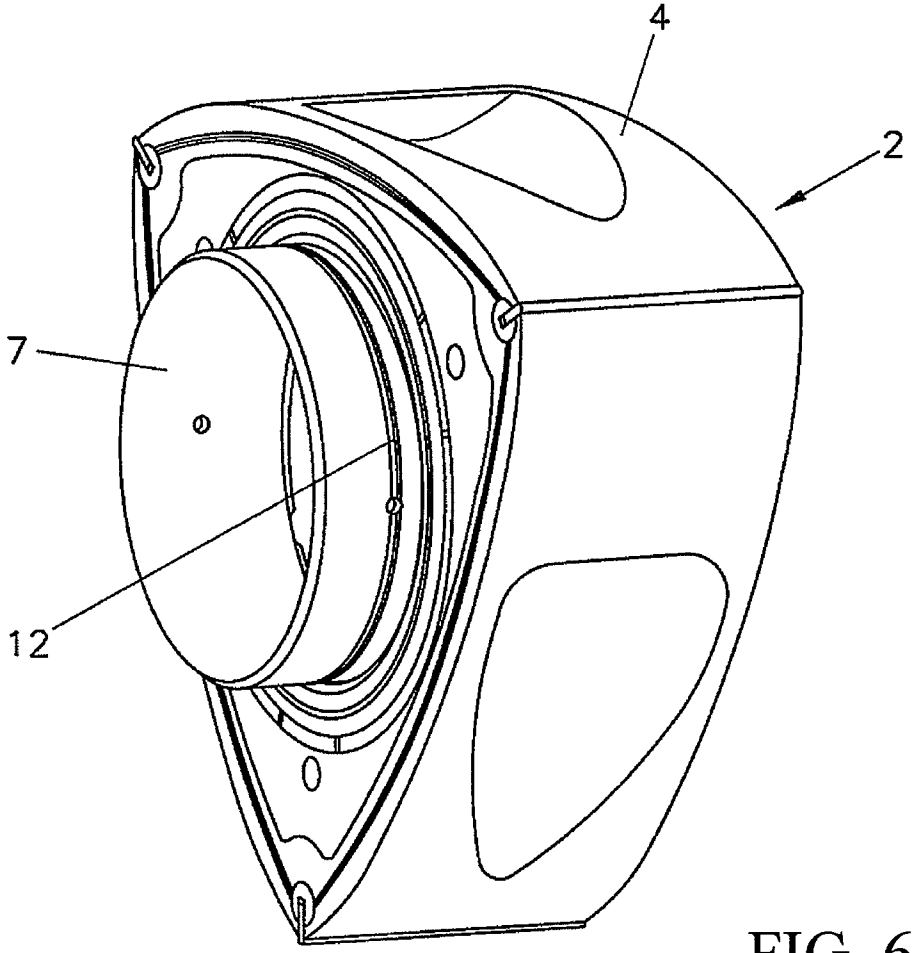
FIG. 6 shows the piston assembly of FIGS. 4 and 5, wherein the bearing ring is partially received in the central bore.

FIG. 6 shows the piston assembly 1 according to FIGS. 4 and 5, wherein the outer bearing ring 7 is partially accommodated by the central bore. The outer bearing ring 7 has not yet reached its predetermined position within the central bore.

Figure 7:
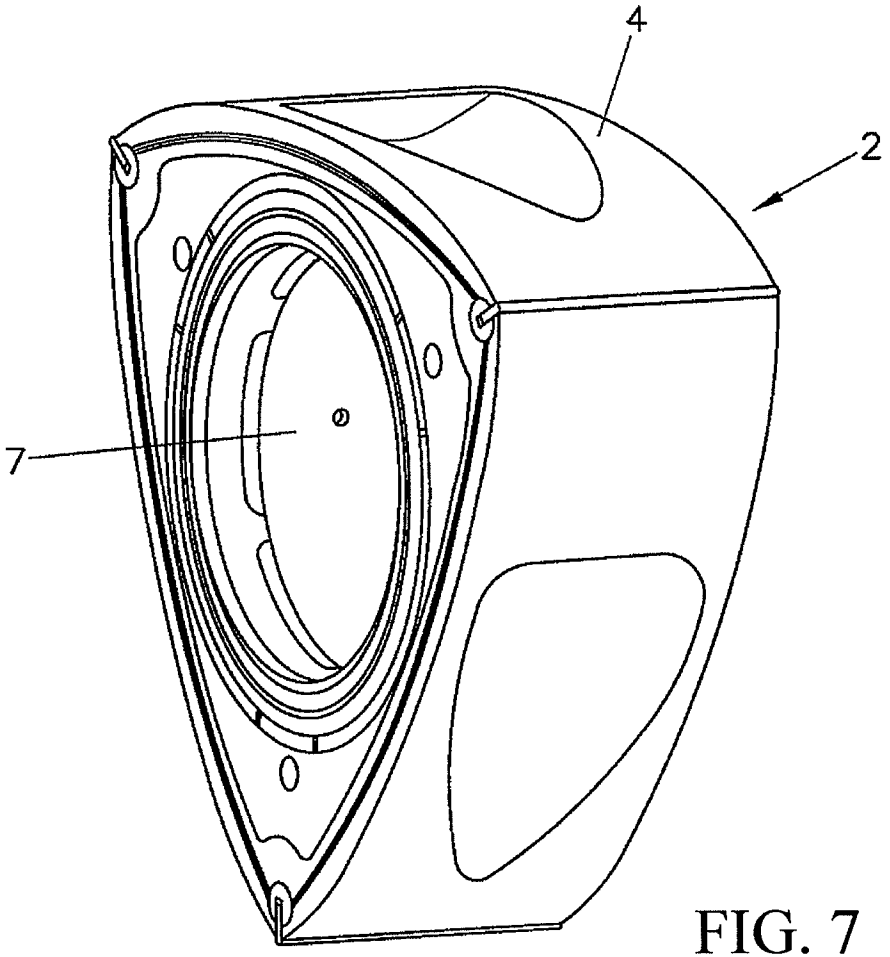
FIG. 7 shows the piston assembly of FIGS. 4-6, wherein the bearing ring is arranged in its position intended use.

FIG. 7 shows the piston assembly 1 according to FIGS. 4, 5 and 6, wherein the outer bearing ring 7 is arranged in its intended position within the rotary piston 2. It is not shown that the connecting, ring 8, after which the outer bearing ring 7 reached its predetermined position has eased with partial displacement in the non-visible second recess.

Figure 8A:
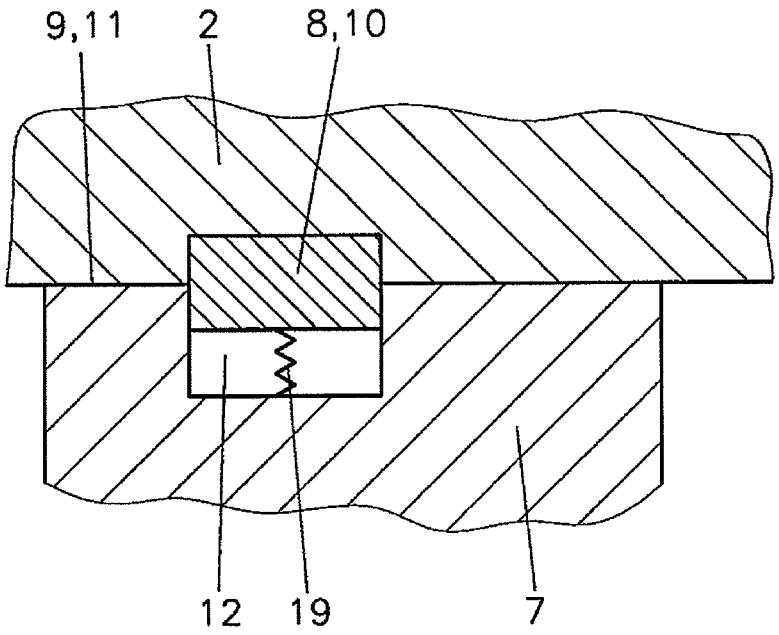
FIGS. 8A and 8B show sectional views of a piston assembly according to one embodiment.
Figure 8B:
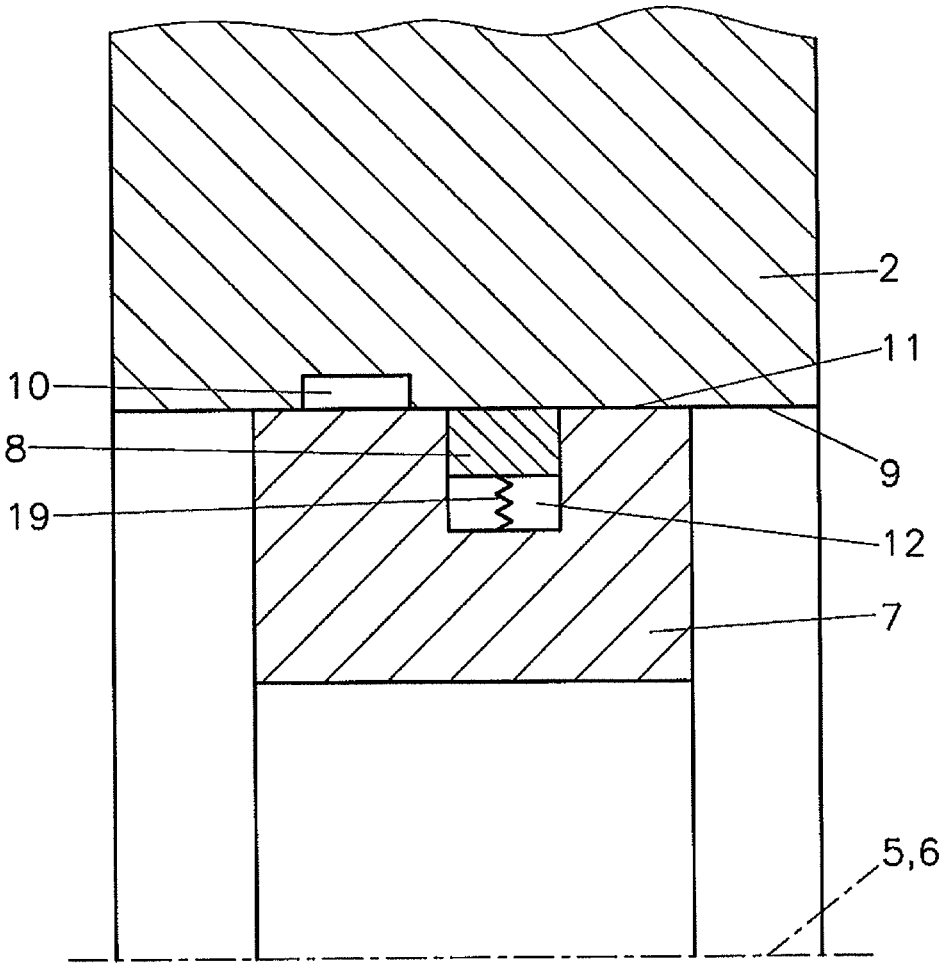

FIGS. 8A and 8B show sectional views of an inventive piston assembly 1 according to another embodiment.

FIG. 8A shows a piston assembly, wherein the bearing ring 7 is disposed in its predetermined location within the cylinder bore. Thus, the first recess 10 and second recess 12 are opposite. The surface of the bore 9 and 11 the outer surface of the bearing ring contact each other. The fuse body 8 comprises a rectangular cross section, in particular the fuse body 8 is formed as a segment of a hollow cylinder. The first recess 10 and second recess 12 are each formed as a groove having a rectangular cross-section. The fuse body 8 is positively connected by the first recess 10 and second recess 12. The Fuse body 8 is applied by means of the spring 19 with a force in the radial direction of the circular piston 2. By the positive fit of the fuse body 8 with the first recess 10 and second recess 12, the outer bearing ring 7 secured against any unwanted movement of the circular regarding piston 2.

FIG. 8B shows a rotary piston assembly, according to another embodiment, in a sectional view, wherein the bearing ring 7 has not yet reached its predetermined position within the central bore. Thus, the spring-loaded fuse body 8 is essentially completely accommodated in the second recess 12. Upon reaching the predetermined position, the first recess 10 and the second recess 12 would be oriented toward each other. The fuse body 8 would be force in the first recess 10.

Figure 9A:
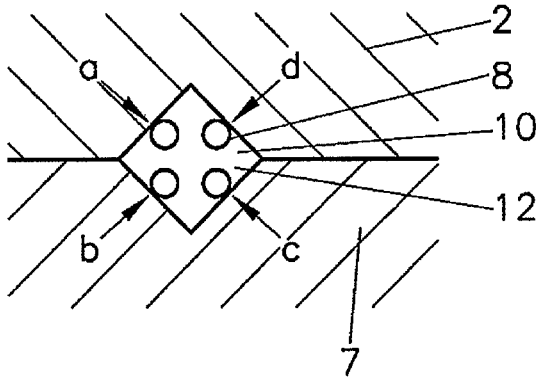
FIGS. 9A and 9B show sectional views of a piston assembly of a wire made fuse body according to another embodiment.
Figure 9B:
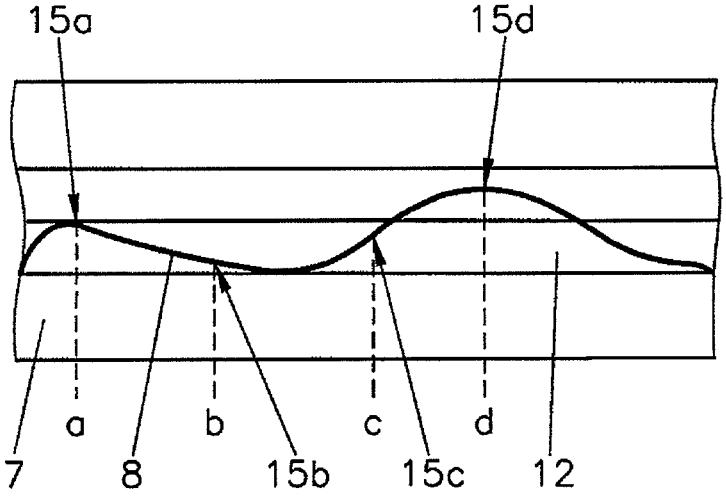

FIGS. 9A and 9B show sectional views of a piston assembly with a wire made fuse body 8 according to another embodiment,. The fuse body 8 extends along the direction along a main extension of the first recess 10 and the second recess 12.

FIG. 9A shows in a sectional view a rotary piston 2 with a V-shaped first recess 10, an outer bearing ring 7 with a second also V-shaped recess 12 and a fuse body 8 according to another embodiment. Although shown with four circles, consists fuse body 8 only of a single pressure-formed wire with a main direction of extension along the extension of the grooves formed as first recess 10 and second recess 12. With the circles cross sections a, b, c, d are shown in different positions of the fuse body 8. So the fuse body 8 touches at different positions along its main direction different constraint surfaces of the first recess 10 and second recess 12. The space formed by the first recess 10 and second recess 12 accommodates the fuse body 8 in an elastically deformed state. The contact regions of fuse body 8 are forced against the constraint surface of the first recess 10 and the second recess 12 for positively connected transmission of a force to both the rotary piston 2 and the outer bearing ring 7 as well.

FIG. 9B shows the bearing ring 7 with a formed in second recess 12 which is formed as a V-shaped groove. Along the second recess 12, the fuse body 8 extends, which is formed as a pressure-formed wire. Along its main direction, the fuse body 8 comprises several contact regions 15, 15*a*, 15*b*, 15*c*, 15*d*. The contact regions 15*b* and 15*c* of the second constraint surface contact the recess 12. The contact regions 15*a* and 15*d* contact constraint surfaces of the first recess, not shown in the rotary piston. The bearing ring 8 is elastically deformed.

Figure 10A:
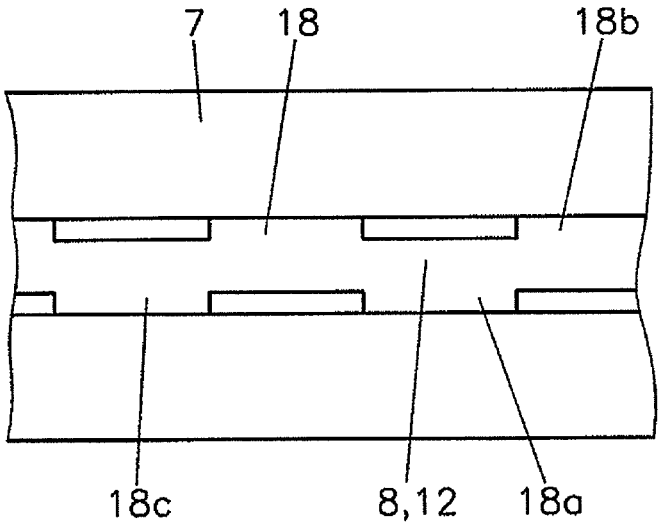
FIGS. 10A and 10B show sectional views of a piston assembly with elastically deformable fuse body with protrusions of the sidewall and projections on the outer circumferential surface of the fuse according to another embodiment.
Figure 10B:
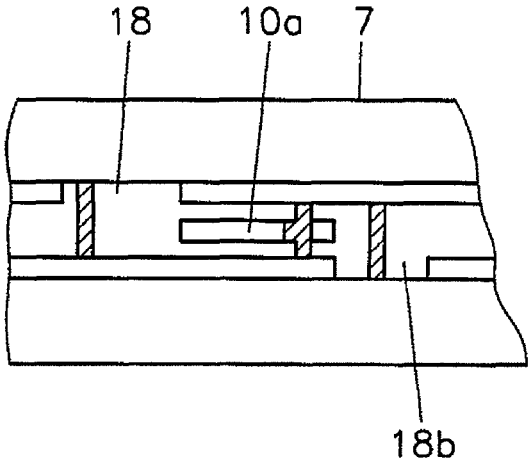

FIGS. 10A and 10B show sectional views of a piston assembly with elastically deformable fuse body with protrusions of the sidewall and projections on the outer circumferential surface of the fuse according to another embodiment. FIG. 10A shows a sectional view of a piston assembly, according to another embodiment, with elastically deformable fuse body 8 with protrusions of the sidewall 18, 18*a*, 18*b*, 18*c*. The outer bearing ring 7 comprises a second recess 12, which is formed as a groove. In the second recess 12 of the fuse body 8 is inserted. The fuse body 8 comprises a plurality of end face projections 18, 18*a*, 18*b*, 18*c*, each of them transmits a normal force component to the second recess 12. Thus, the bearing ring 8 is accommodated in the second recess 12 positively connected. It is not shown, that the fuse body 8 is also positively connected in the first recess in the surface of the bore. The fuse body 8 comprises in an elastically deformed state the room of not shown first recess and second recess 12. With a design according to this embodiment manufacturing costs are reduced because only the end face projections 18, 18*a*, 18*b*, 18*c* need to have low size tolerances. With this embodiment, material and energy savings are reachable. Further, the end face projections allow that a lubricant between the bearing ring and the rotary piston can be replaced. The fuse body 8 is designed as an interrupted connection ring. The connecting ring 7 is completely insertable into the central bore substantially in the second recess 12 prior to insertion of the bearing ring, in particular the fuse body 8 is converted into an elastically deformed state.

FIG. 10B shows a fuse body 8 whose fuse body circumferential surface also comprises a projection 18*a*. This projection 18*a* is particularly used to save material and machining costs because instead of the entire fuse body circumferential surface only the projection 18*a* needs to be made with low size tolerance. Further the end face projections can allow that a lubricant between the bearing ring and the rotary piston can be replaced.

While the above description has pointed out features of various embodiments, the skilled person will understand that various omissions, substitutions, and changes in the form and details of the device or process illustrated may be made without departing from the scope of the appended claims.

What is claimed is:

1. A piston assembly, comprising:

a rotary piston, wherein the rotary piston comprises an axis of rotation, wherein the rotary piston defines a central bore having a bore axis and wherein the rotary piston includes at least two curved constraint surfaces, and wherein the bore axis substantially corresponds to the first axis of rotation, a hollow-cylindrical bearing ring configured to be at least partially inserted in the central bore, and at least one fuse body configured to connect the rotary piston and the hollow-cylindrical bearing ring, and to transmit opposing forces in opposite axial directions with respect to the axis of rotation of the rotary piston and the hollow-cylindrical bearing ring, wherein an elastic restoring force of the at least one fuse body generates a radial force with respect to the central bore.

2. The piston assembly of claim 1, wherein the central bore is limited by a surface of the bore, wherein the surface of the bore comprises at least a first recess, wherein the bearing ring comprises an outer surface of the bearing ring, wherein the outer surface of the bearing ring comprises at least one second recess, and wherein the at least one of the second recess is formed as a through hole in at least one of the bearing ring and the at least one fuse body is connected to both the first recess and the second recess.

3. The piston assembly of claim 2, wherein at least one fuse body is at least partially received by both the first recess and the second recess so as to be connected to each other.

4. The piston assembly of claim 1, wherein at least one of the outer surface of the at least one of the bearing ring and the surface of the bore comprises at least partially an insertion aid.

5. The piston assembly of claim 1, wherein a surface of the bore comprises a substantially ring-shaped first recess, wherein an outer surface of the bearing ring comprises a substantially ring-shaped second recess.

6. The piston assembly of claim 1, wherein the at least one fuse body comprises at least one of:

a rectangular cross-section and a fuse body circumferential surface wherein the fuse body circumferential surface is arranged substantially parallel to the surface of the bore; and at least one end face, wherein the at least one end face is at least partially perpendicular to the first axis of rotation or is oriented to the fuse body circumferential surface, wherein the at least one end face at least partially contacts the at least one of a constraint surface of a first recess and a constraint surface of a second recess, wherein the at least one end face is transmits a normal force to at least one of the constraint surface of the first recess and the constraint surface of the second recess.

7. The piston assembly of claim 6, wherein the at least one end face has a wave shape and at least one protrusion.

8. The piston assembly of claim 7, wherein the at least one end face has at least one protrusion configured to contact the at least one of the constraint surface of the first recess and the constraint surface of the second recess.

9. The piston assembly of claim 6, wherein the at least one end face comprises at least one end face projection, wherein the at least one end face projection is configured to be in surface contact with the at least one of the constraint surface of the first recess and the constraint surface of the second recess, wherein the at least one end face projection is configured to transmit a component of normal force to the at least one of the constraint surface of the first recess and the constraint surface of the second recess.

10. The piston assembly of claim 1, wherein a cross section of the at least one fuse body is triangular, rectangular, polygonal, rectangular, square, ring shaped, annular, elliptical, X-shaped or U-shaped, and wherein the at least one fuse body is formed at least partially of a metal, iron, aluminum, copper, zinc or alloys thereof.

11. The piston assembly of claim 1, wherein the piston assembly is used for a rotary piston engine.

12. A rotary piston engine, comprising:

at least one piston assembly, wherein the piston assembly comprises i) a rotary piston, wherein the rotary piston comprises a axis of rotation, wherein the rotary piston defines a central bore having a bore axis, wherein the rotary piston includes at least two curved constraint surfaces, and wherein the bore axis substantially corresponds to the axis of rotation, ii) hollow-cylindrical bearing ring configured to be at least partially inserted in the central bore, and iii) at least one fuse body configured to connect the rotary piston and the hollow-cylindrical bearing ring, and to transmit opposing forces in opposite axial directions with respect to the axis of rotation of the rotary piston and the hollow-cylindrical bearing ring, wherein the at least one piston assembly is mounted on an eccentric shaft by a rolling bearing or sliding bearing, and wherein an elastic restoring force of the at least one fuse body generates a radial force with respect to the central bore.

13. A hybrid/electric vehicle, comprising:

a rotary piston engine including at least one piston assembly, wherein the piston assembly comprises i) a rotary piston, wherein the rotary piston comprises a axis of rotation, wherein the rotary piston defines a central bore having a bore axis, wherein the rotary piston includes at least two curved constraint surfaces, and wherein the bore axis substantially corresponds to the axis of rotation, ii) a hollow-cylindrical bearing ring configured to be at least partially inserted in the central bore, and iii) at least one fuse body configured to connect the rotary piston and the hollow-cylindrical bearing ring, and to transmit opposing forces in opposite axial directions with respect to the the rotary piston and the hollow-cylindrical bearing ring, wherein the at least one piston assembly is mounted on an eccentric shaft by a rolling bearing or sliding bearing, and wherein an elastic restoring force of the at least one fuse body generates a radial force with respect to the central bore.

* * * * *